US007855868B2

(12) United States Patent
Taishi et al.

(10) Patent No.: US 7,855,868 B2
(45) Date of Patent: Dec. 21, 2010

(54) AEROSOL CHARGE NEUTRALIZING DEVICE

(75) Inventors: Tsuyoshi Taishi, Tokyo (JP); Tetsuji Koyama, Tokyo (JP); Soon Bark Kwon, Uiwang (JP); Takafumi Seto, Tsukuba (JP); Hiromu Sakurai, Tsukuba (JP)

(73) Assignees: Tsukasa Sokken Co., Ltd., Tokyo (JP); National Institute of Advanced Industrial Science and Technology, Tokyo (JP)

( * ) Notice: Subject to any disclaimer, the term of this patent is extended or adjusted under 35 U.S.C. 154(b) by 352 days.

(21) Appl. No.: 12/094,679

(22) PCT Filed: Nov. 21, 2006

(86) PCT No.: PCT/JP2006/323864

§ 371 (c)(1),
(2), (4) Date: Aug. 14, 2008

(87) PCT Pub. No.: WO2007/061120

PCT Pub. Date: May 31, 2007

(65) Prior Publication Data

US 2009/0047189 A1 Feb. 19, 2009

(30) Foreign Application Priority Data

Nov. 24, 2005 (JP) ..... 2005-338546

(51) Int. Cl.
*H05F 3/00* (2006.01)

(52) U.S. Cl. ..... 361/212; 361/213

(58) Field of Classification Search ..... 361/212, 361/213, 220, 321

See application file for complete search history.

(56) References Cited

U.S. PATENT DOCUMENTS 3,503,704 A * 3/1970 Marks ..... 423/212
5,428,220 A * 6/1995 Ehara ..... 250/281
6,145,391 A * 11/2000 Pui et al. ..... 73/865.5

FOREIGN PATENT DOCUMENTS

JP 2005-106670 A 4/2005
JP 2006-196291 A 7/2006

* cited by examiner

*Primary Examiner*—Danny Nguyen
(74) *Attorney, Agent, or Firm*—Lucas & Mercanti, LLP

(57) ABSTRACT

An aerosol charge neutralizing device simple in structure and easy to maintain, comprising an aerosol passing container that has a conductive material-made tube body constituting an aerosol passing path permitting aerosol to flow therethrough and has an opening pair consisting of openings in pair disposed oppositely across the center line of the tube body and penetrating through the wall surface of the tube body, and insulation tube that has an insulation material-made tube, has a window pair consisting of windows in pair disposed oppositely across the center line of the tube and penetrating through the wall surface of the tube, and is fitted concentrically over the outer surface of the aerosol passing container with the windows coinciding with the openings, a bipolar ionizing element that has a discharge electrode on a dielectric film and is attached to the insulation tube with the windows closed and the discharge electrode exposed to the aerosol passing path, and an outer tube that includes air-tightly the insulation tube and the bipolar ionizing element between it and the aerosol passing container.

5 Claims, 4 Drawing Sheets

AEROSOL CHARGE NEUTRALIZING DEVICE

TECHNICAL FIELD

The present invention relates to technologies regarding neutralization of a charge distribution of aerosol, which technologies are utilized for simply realizing a known charge distribution in size distribution measurements of particles in aerosol and the like technologies.

BACKGROUND ART

The number of charges of constituent particles of an aerosol has generally a distribution. Neutralizing techniques which make the average of the charge distribution nearly zero are widely used as important techniques in the field of particle size distribution measurements of aerosol particles by electric mobility classification, Electric mobility distribution measurements by neutralizing techniques have been discussed in detail (refer to Non-Patent Document 1). Products utilizing neutralizing techniques have been made commercially available by a plurality of manufacturers including USA TSI Incorporated. These measurement apparatus have been used widely for measuring a particle size distribution in a manufacture process using fine particles, and a particle size distribution of fine particles in atmospheric aerosol or in a car exhaust gas.

Although most of constituent particles of aerosol in a neutralized charge distribution are not charged, there are some particles having positive or negative monovalent or multivalent charges. The number of particles at each valence is almost equal for positive and negative particles. In a graph having as an abscissa a charge valence and as an ordinate an existence frequency of particles at each charge valence, an existence frequency distribution is in positive/negative symmetry having zero as a most frequent value. This charge distribution state is called a neutralized state. A distribution of the number of charged particles and a distribution of the ratio between charged and uncharged particles are already known for each particle diameter in the neutralized state. Therefore, a particle size distribution of all particles including uncharged particles can be converted from a particle size distribution of charged particles measured by an electric mobility method, and can be calculated precisely.

An apparatus utilizing radioactive substance is used most frequently to neutralize aerosol particles. The neutralizer of this type is described in detail, for example, in Non-Patent Document 1, and an example of the structure is shown in FIG. 8. In this neutralizer 50, high energy particles radiated from radioactive substance 51 collide with gas molecules to generate a number of ions, the numbers of whose positive and negative ions are nearly equal. Bipolar ions generated in this manner attach to floating particles during a Brownian motion so that a charged particle quantity of each particle changes. In the state that nearly the same numbers of positive and negative ions exist, an attachment probability of an ion to a charged particle having a polarity opposite to that of the ion is larger than an attachment probability of an ion to a charged particle having the same polarity to that of the ion. Therefore, this attachment reaction between particles and positive and negative ions makes most of particles uncharged. However, some particles are charged positive or negative monovalent, and a smaller number of particles are charged positive or negative multivalent. As a whole, the above-described neutralized state is achieved.

To generate bipolar ions so as to neutralize aerosol, electrical discharges may be utilized. For example, at the same time when positive ions are generated through positive DC corona discharge, negative ions are generated through negative DC corona discharge to mix these ions and obtain negative and positive ions whose numbers are almost equal. This neutralizer has an ion generating field separated from a particle charge neutralizing field. This separation is necessary for preventing a loss of particles in the DC corona discharge field (refer to Non-Patent Documents 2 and 3). There is discussion on application of a bipolar ion generator apparatus utilizing an AC corona generator apparatus to neutralization of aerosol particles. With this neutralizing method, however, the bipolar ion generating field is separated from the particle charge neutralizing field, too (refer to Patent Document 1).

A charge neutralizer utilizing creepage barrier discharge and an AC power source (refer to Patent Document 2) has characteristics that (1) a relatively high frequency is required to obtain a high ion concentration, (2) a high ozone concentration, and (3) no bias is necessary for the control of ion balance.

As the neutralizing techniques through generation of bipolar ions, there is another technique for generating positive ions and photoelectrons utilizing photoelectron emission by ultraviolet irradiation (refer to Patent Document 3).

This method, however, depends on a principle that the numbers of positive/negative ions are adjusted by generating a DC electric field in the neutralizer. Therefore, charged particles are transported to the neutralizer wall by the electric field in the neutralizer and lost. Since electric mobility measurements are effective only for charged particles, this neutralizing method in combination with the electric mobility measurement is not suitable for practical use.

There are a number of other proposals and measures relative to the techniques of adjusting a charge distribution of aerosol particles. These techniques do not aim at neutralization, but most of these techniques aim to change particles in an uncharged state to particles in a charged state, by utilizing positive or negative single polarity ions.

Charging techniques and transport controlling techniques aiming to facilitate transport control of particles in space through particle charging, are utilized for improvement of a productivity efficiency in a manufacture process using particles as material particles (refer to Patent Document 4), for control of toner particles in a copy machine (refer to Patent Document 5), for removal of particles in air of electric dust collection (refer to Patent Document 6), and for increase of a measurement sensitivity of a particle measuring apparatus having a sensitivity only to charged particles (refer to Patent Document 7).

Among these charging techniques, monopolar ions generated by DC discharge are used (refer to Patent Document 8), or only single polarity components are extracted from bipolar ions generated from radioactive substance (refer to Patent Document 9). However, with any of these approaches aiming to charge uncharged particles, a charge distribution of particles is shifted from zero to either positive or negative, and a neutralized state of the charge distribution cannot be realized. Further, since a number of multivalent charged particles are generated, there arises a problem of sensitivity crossing that a large particle having multivalent charges and fine particles having a monovalent charges are measured as having the same electric mobility, in the particle distribution measurements by the electric mobility method. It is therefore difficult to apply such particle charging techniques directly to the neutralizing techniques aiming at particle diameter measurements by the electric mobility method.

Patent Document 1: Japanese Patent Publication No. 3393270

Patent Document 2: Japanese Patent Unexamined Publication No. 2005-106670

Patent Document 3: Japanese Patent Publication No. 2670942

Patent Document 4: Japanese Patent Unexamined Publication No. 2002-190258

Patent Document 5: Japanese Patent Unexamined Publication No. 2000-187369

Patent Document 6: Japanese Patent Unexamined Publication No. SHO52-99480

Patent Document 7: Japanese Patent International Publication No. 2000-504111

Patent Document 8: Japanese Patent Publication No. SHO-62-19033

Patent Document 9: Japanese Patent Publication No. HEI-24357

Non-Patent Document 1: Knutson, E. O. (1976), Extended electric mobility method for measuring aerosol particle size and concentration, Fine Particles, Aerosol Generation, Measurement, Sampling, and Analysis. B. Y. H. Liu. New York, N.Y., Academic press: 740-762.

Non-Patent Document 2: Adaci, M. et al. (1993), "Aerosol charge neutralization by a corona ionizer." Aerosol Sci. Technol. 18:48-58.

Non-Patent Document 3: Wiedensohler, A. (1988). "An approximation of the bipolar charge distribution for particles in the submicron size range." J. Aerosol Sci. vol. 19, 3:387-389.

DISCLOSURE OF THE INVENTION

Problems to be Solved by the Invention

The above-described neutralizer utilizing radioactive substance has a limit that the neutralizer can be used only at a site permitted to use radioactive substance and only by a person permitted to deal with radioactive substance. Even if the permission conditions are satisfied, safety management and storage are required to be carefully made in order to avoid influence upon human bodies to be caused through use of radioactive substance.

In the neutralizer utilizing corona discharge described in Non-Patent Document 2 and Patent Document 1, as the ion generator unit is separated from an aerosol flow path, and gas introduction and flow rate control dedicated to the ion generator unit are required in order to mix ions generated in the ion generator unit with aerosol to be neutralized, resulting in a complicated structure of the neutralizing apparatus. Further, mixing ion-containing gas with aerosol to be neutralized dilutes aerosol and lowers a particle concentration. Furthermore according to Patent Document 3, the DC electric field in the apparatus causes a loss of charged particles.

The neutralizer utilizing AC discharge in Patent Document 2 has the characteristics that a relatively high frequency is required to obtain a high concentration, and an ozone concentration is high. Since a high frequency is required, there arises an issue that a high speed amplifier is required for a power source, resulting in a large size of the apparatus and a high cost.

Means for Solving the Problems

According to the present invention, pulse voltages applied with DC biases are applied to fine electrodes for discharge, and ion generator elements generate positive and negative ions separately to thereby neutralize a charge distribution of aerosol. Electrodes of the ion generator elements are disposed so as to make the electrodes of the same polarity face each other, allowing to cancel out scattering of ions and succeeding in manufacturing a charge neutralizer without particle loss even with DC discharge. An ion generating function can be provided very near to a particle neutralizing volume, succeeding in manufacturing an aerosol charge neutralizer having a simple structure and being easy to be controlled. The electrode of a bipolar ion generator element is disposed very near to the particle neutralizing volume, and an insulating case made of electrically insulating material is used. It is therefore possible to realize electrical insulation between the electrode of the bipolar ion generator element and an aerosol flowing container and to succeed in manufacturing a charge neutralizer which is compact and provides easy maintenance such as electrode replacement. By using pulse discharge, generation of ozone to be caused by discharge can be suppressed not larger than 100 ppb.

Namely, the present invention provides an aerosol charge neutralizer comprising: an aerosol flowing container having an aerosol input port at an upstream end, an aerosol output port at a downstream end, a tubular body made of conductive material and constituting an aerosol flow path capable of flowing aerosol, and an opening pair having a pair of openings disposed facing each other via the center line of the tubular body, each opening extending through a wall of the tubular body; an insulating tube having a tubular portion made of insulating material and a window pair having a pair of windows disposed facing each other via the center line of the tubular portion, each window extending through a wall of the tubular portion, and the insulating tube being concentrically engaged with an outer surface of the aerosol flowing container in such a manner that the window becomes coincident in position with the opening; a bipolar ion generator element having a discharge electrode formed on a dielectric film and closing the window, the bipolar ion generator element being mounted on the insulating tube in such a manner that the discharge electrode is exposed in the aerosol flow path; and an outer tube accommodating the insulating tube, the opening and the bipolar ion generator element in an airtight manner relative to the aerosol flowing container.

ADVANTAGES OF THE INVENTION

According to the present invention, since the bipolar ion generator elements utilizing pulse voltages applied with DC biases are used without using radioactive substance, there is therefore no restriction in using the neutralizer otherwise to be caused by use permission and dealing permission. Further, dealing and storage of the neutralizer are easier than utilizing radioactive substance.

According to the present invention, the ion generator element utilizing pulse voltages applied with DC biases uses a discharge electrode having a structure that fine sharp edges are formed on the surface thereof. In addition, positive and negative electrodes are disposed in such a manner that the same polarity faces each other. There is therefore no particle loss near the electrodes even if discharge is used, so that the discharge electrode can be disposed near the flow path of aerosol to be neutralized. Accordingly, an ion generator unit is not necessary to be separated from the aerosol flow and is not necessary to introduce gas newly so that the structure of a device such as a flow rate controller can be simplified.

According to the present invention, a power source for generating applied voltages for discharge uses a power source capable of controlling generation/stop of the discharge voltage. By controlling this power source, a neutralization function can be controlled without dismounting the power source.

In the present invention, applied voltages for discharge use pulse discharge so that a generated ozone concentration can be suppressed not larger than 100 ppb.

In the present invention, applied voltages for discharge are pulse voltages applied with DC biases. Since an amplifier for generating high frequency and the like are not necessary, it is possible to make compact the neutralizer including the power source.

According to the present invention, applied voltages for discharge are pulse voltages applied with DC biases, and positive and negative electrodes are used. By controlling the applied voltages, a bipolar ion balance can be changed.

Most importantly, the aerosol charge neutralizer of the present invention has main components of an aerosol flowing container, an insulating case and an outer tube respectively disposed concentrically, capable of assembly and dismount by sliding each component along a center line direction. The structure is therefore simple and maintenance is easy.

Figure 1:
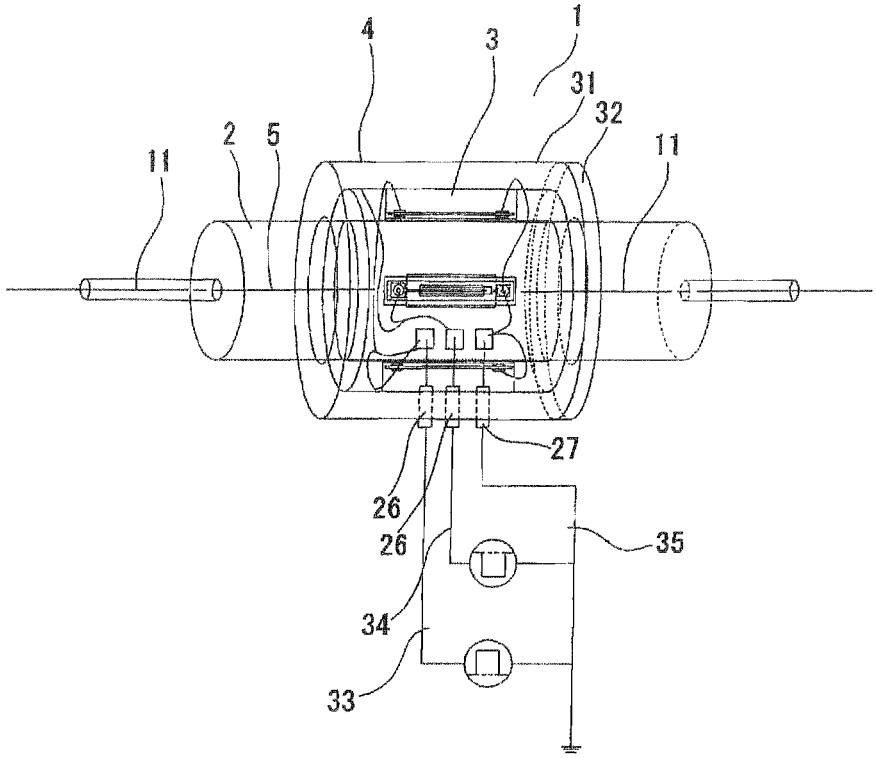
FIG. 1

A schematic perspective view of an aerosol charge neutralizer according to an embodiment of the present invention.

FIG. 2

A vertical cross sectional view of the aerosol charge neutralizer according to the embodiment of the present invention.

FIG. 3

A schematic perspective view of an aerosol flowing container.

FIG. 4

Diagrams showing an electrode body, (a) is a plan view of the electrode member, (b) is a cross sectional view taken along b-b in (a), (c) is a top view of the electrode member, and (d) is a bottom view of the electrode member.

FIG. 5

A schematic perspective view of an insulating case of the aerosol charge neutralizer according to the embodiment of the present invention.

FIG. 6

(a) is a schematic diagram showing installation of a bipolar ion generator element, (b) is a schematic diagram showing a bipolar DC pulse of a power source.

FIG. 7

Typical ion concentrations by the aerosol charge neutralizer of the present invention and typical ion concentrations by a conventional neutralizer utilizing radioactive substance (Table 1), a ratio of charged particles relative to a particle diameter when particles (20 to 200 mm) of single dispersion and uncharged are charged and neutralized, with the aerosol charge neutralizer of the present invention, and with the conventional neutralizer utilizing radioactive substance.

FIG. 8

A schematic perspective view of a conventional aerosol charge neutralizer utilizing radioactive substance.

DESCRIPTION OF REFERENCE NUMERALS

1 . . . aerosol charge neutralizer, 2 . . . aerosol flowing container, 3 . . . insulating case, 4 . . . outer tube, 5 . . . aerosol flow path, 6 . . . aerosol input port, 7 . . . aerosol output port, 8 . . . slit pair, 8*a*, 8*b* . . . slit, 11 . . . center line, 12 . . . tubular portion, 13 . . . wiring portion, 14 . . . window pair, 14*a*, 14*b* . . . window, 16 . . . groove, 17 . . . electrode member, 18 . . . discharge electrode, 21 . . . insulating film, 23 . . . ground electrode, 24 . . . O-ring, 25 . . . conductive wire, 26 . . . current input terminal, 27 . . . ground current terminal, 28 . . . pulse power source, 31 . . . main body, 32 . . . lid, 33 . . . conductive wire, 34 . . . conductive wire, 35 . . . conductive wire, 50 . . . apparatus, 51 . . . radioactive substance

BEST MODE FOR CARRYING OUT THE INVENTION

In an aerosol charge neutralizer of the present invention, bipolar ion generator elements utilizing pulse voltages applied with DC biases are disposed very near to slits formed through a conductive member forming a space, and positive and negative electrodes of an even number of bipolar ion generator elements are disposed in such a manner that the same polarity faces each other. Electrodes of the bipolar ion generator elements are disposed by using an insulating case made of insulator, being capable of easy mount/dismount and having slits corresponding to the slits of the conductive member, to thereby realize electrical insulation and position fixing.

Also in the present invention, the bipolar ion generator elements utilizing pulse voltages applied with DC biases have a discharge electrode and a ground electrode, and the discharge electrode has fine sharp edges. The ground electrode surrounds the discharge electrode via a thin insulating film. In the aerosol charge neutralizer, each electrode pair can form an electric field only locally in the space near the electrode.

The discharge electrode is disposed very near to each slit disposed along the aerosol flow path. The discharge electrodes of the bipolar ion generator elements are disposed parallel along a main stream of aerosol, and pulse voltages applied with positive and negative DC biases are applied to the electrode pair. The pulse voltages applied with positive and negative DC biases are set to proper values so as to generate positive and negative ions having the same quantity.

With reference to the accompanying drawings, description will be made on the details of an aerosol charge neutralizer according to the present invention.

Figure 2:
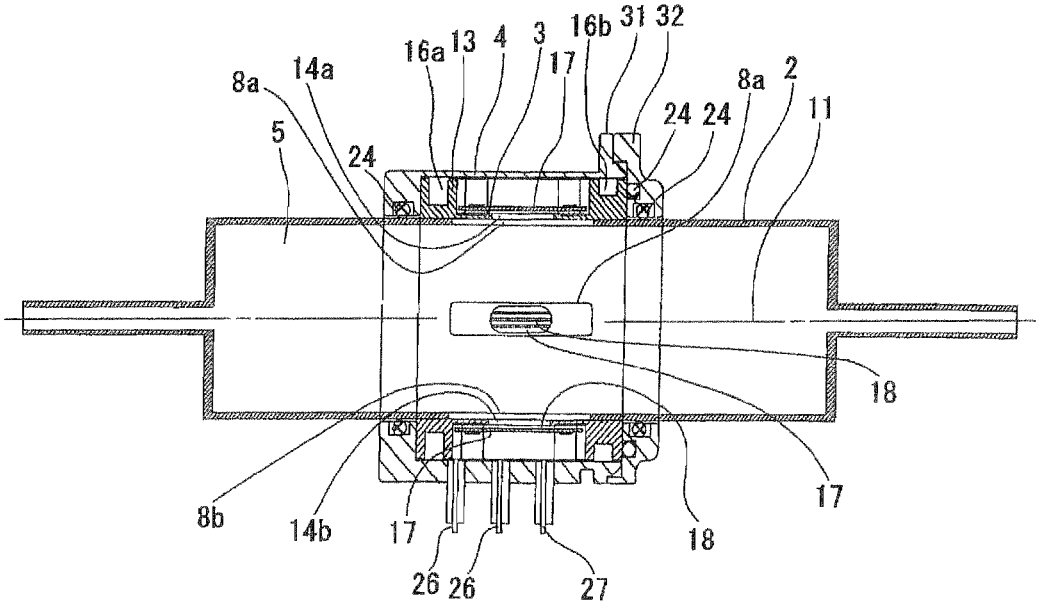
Figure 3:
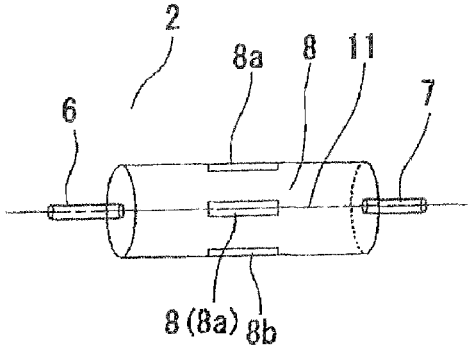
Figure 4:
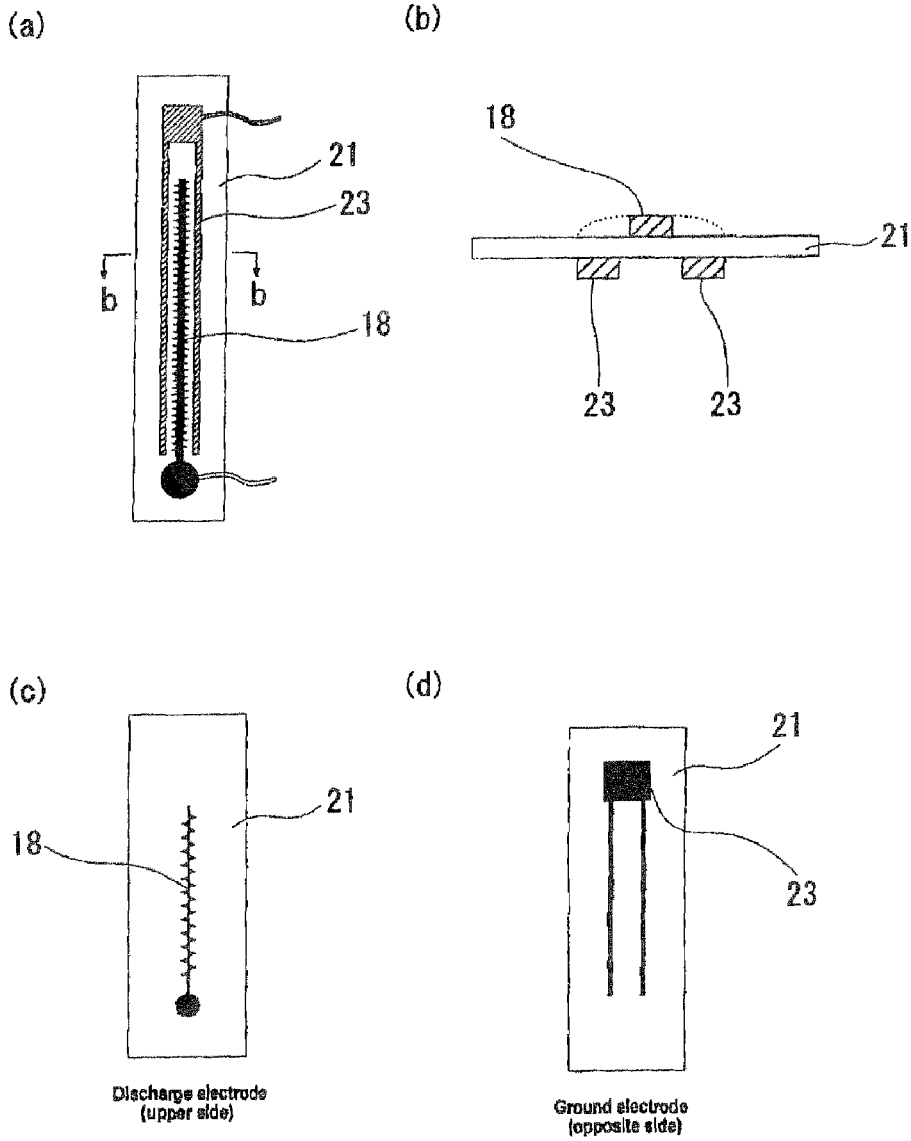
Figure 5:
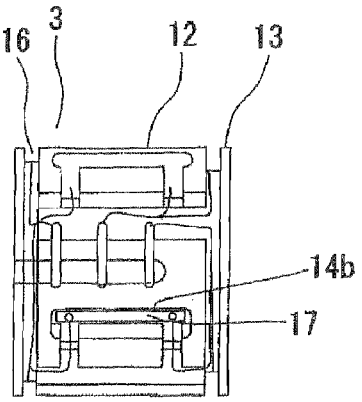

FIG. 1 shows the whole structure (perspective view) of the aerosol charge neutralizer. FIG. 2 shows an aerosol flowing container. FIG. 3 shows an electrode a5 of a bipolar ion generator element, FIG. 4 is a cross sectional view of the aerosol charge neutralizer, and FIG. 5 shows an insulating case made of a tubular insulator of the aerosol charge neutralizer.

In FIGS. 1 and 2, reference numeral 1 represents the aerosol charge neutralizer.

The aerosol charge neutralizer 1 has an aerosol flowing container 2, an insulating case 3 and an outer tube 4 respectively having generally a tubular shape and disposed concentrically relative to a center line 11.

The aerosol flowing container 2 forms an aerosol flow path 5 for flowing aerosol. As shown in FIG. 3, the aerosol flowing container is a metal tubular body made of conductor such as stainless steel, and has an aerosol input port 6 and an aerosol output port 7 at opposite ends along a center line direction. Generally in a central region of the aerosol flowing container 2 along the center line 11 direction, one or a plurality of slit pairs 8 are formed. The slit pair 8 is constituted of two slits 8*a* and 8*b* forming openings through the wall of the aerosol flowing container at positions facing each other via the center line 11. The slits 8*a* and 8*b* are formed at symmetrical positions relative to the center line 11, and form openings through the wall of the aerosol flowing container 2. The aerosol flow path 5 communicates with an external via the slits 8*a* and 8*b*. A plurality of slit pairs may be formed. Also in this case, two slits 8*a* and 8*b* of each slit pair 8 are required to be disposed at symmetrical positions relative to the center line 11.

The insulating case 3 is mounted outside generally the central region of the aerosol flowing container 2 along the center line 11 direction. As shown in FIG. 5, the insulating case 3 has a tubular portion 12 in the central region and wiring portions 13 at opposite ends. A window pair 14 is formed through the wall of the tubular portion 12 at the same angular positions corresponding to the positions of the slit pair 8 of the aerosol flowing container 2. Each window pair is constituted of windows 14*a* and 14*b* at symmetrical positions relative to the center line 11 corresponding to the positions of the slit pair of the aerosol flowing container 2. The window 14*a* is coincident and communicates with the slit 8*a*, whereas the window 14*b* is coincident and communicates with the slit 8*b*. The wiring portions 13 at opposite ends are each formed in a channel shape, and a groove 16 opening upward for accommodating wirings is formed on an outer circumference surface.

Electrode members 17 as bipolar ion generator elements are mounted on the outer surface of the tubular portion 12 of the insulating case 3, and cover and close the windows 14*a* and 14*b*. Discharge electrodes 18 of the electrode members 17 face the windows 14*a* and 14*b* so that the discharge electrodes 18 are exposed to the aerosol flow path 5 via the slits 8*a* and 8*b* of the aerosol flowing containers 2. Tons generated by the discharge electrode 18 are therefore introduced into a particle neutralizing field in the aerosol flowing container 2, while the discharge electrode is maintained electrically isolated from the aerosol flowing container 2. The discharge electrode 18 is required to maintain stable discharge upon application of a pulse voltage applied with a DC bias. In the present invention, a surface plasma discharge electrode structure is adopted.

As shown in FIG. 4(*a*), the electrode member 17 has the discharge electrode 18 and a ground electrode 23 formed on an insulating film 21. The insulating film 21 is an insulating material sheet such as a mica sheet. The insulating film 21 made of a mica sheet has a rectangular shape of 30 mm×20 mm and a thickness of 0.08. The discharge electrode 18 and ground electrode 23 are made of stainless steel.

As shown in FIGS. 3(*b*) to 3(*d*), the discharge electrode 18 is formed on the top surface 21 of the insulating film 21, and the ground electrode 23 is formed on the bottom surface thereof. The discharge electrode 18 is 0.08 mm thick, 0.1 mm wide and 18 mm long.

The ground electrode 23 is bifurcated, and each bifurcated portion is 0.08 mm thick, 0.1 mm wide and 16 mm long. The discharge electrode 18 has a number of sharp edges which are effective for suppressing generation of ozone.

Figure 6:
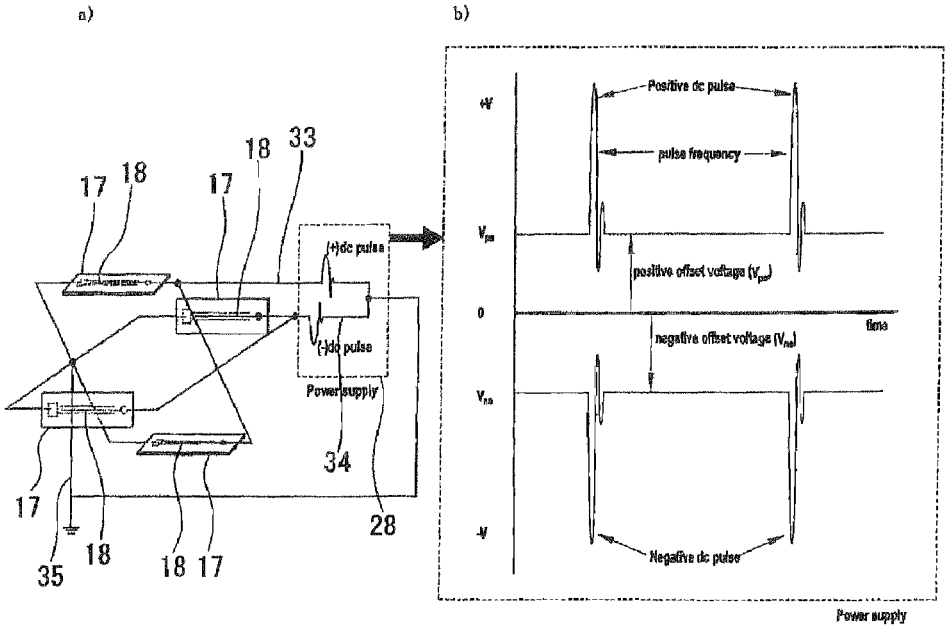
Figure 7:
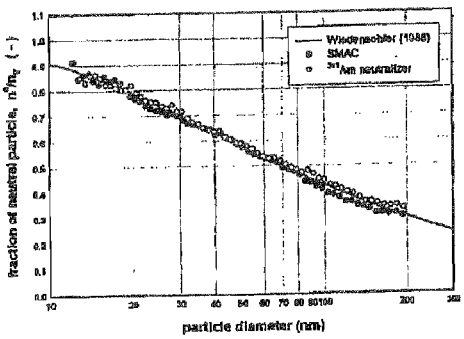
Figure 8:
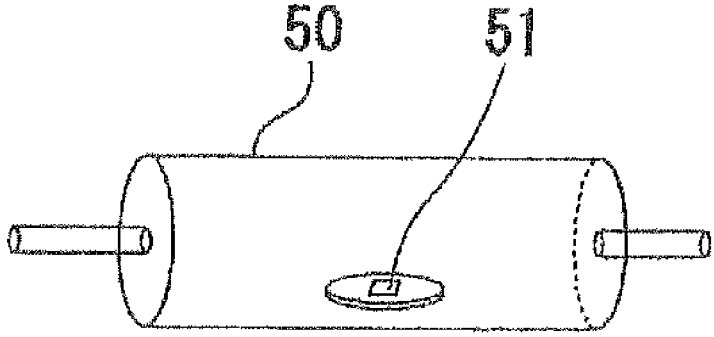

A power source is designed so as to supply positive and negative bipolar DC pulses at the same time. FIG. 6(*a*) is a schematic diagram of wirings showing a connection state between the electrode members 17 and a pulse power source 28. A positive DC pulse is biased by a positive offset electrode Vpo and a negative DC pulse is biased by a negative offset electrode Vno.

Pulse voltages applied with DC biases are applied to the discharge electrodes 18 of the electrode members 17 as bipolar ion generator element shown in FIG. 4 via conductive wires 33 and 34. The ground electrode 23 is disposed surrounding the discharge electrode 18 via the thin insulating layer. A space between the discharge electrode 18 and ground electrode 23 is set as narrow as possible in a range capable of obtaining stable discharge. The ground electrode 23 is grounded via a conductive wire 35.

The outer tube 4 is mounted on the outer surface of the aerosol flowing container 2 in such a manner that the electrode members 17 and insulating case 3 are covered in an airtight state. An O-ring 24 is disposed between the outer tube 4 and aerosol flowing container 2 to maintain the air tight state therebetween. The insulating case 3 and electrode members 17 are therefore maintained in the airtight state between the outer tube 4 and aerosol flowing container 2.

Conductive wires 25 to the discharge electrodes 18 are connected to the pulse power source 28 for generating pulse voltages applied with positive and negative DC biases via a current input terminal 26 and a ground current terminal 27 on the outer surface of the insulating case 3. The pulse power source has a structure that output voltages are controlled by using a trimmer provided on each side of positive and negative voltages. The conductive wires 25 are disposed in the wiring portions 13 of the insulating case made of a tubular insulator, and have a structure capable of suppressing a particle loss to be caused by an electric field generated around the conductive wires 25.

An O-ring 24 is disposed between the outer tube 4 and aerosol flowing container 2 and between a main body 31 of the outer tube and a rid 32 to suppress gas leakage, and a structure is adopted which allows connection to the pulse power source 28 applied with DC biases.

A flow rate of aerosol flowing through the neutralizer is determined by flow rate control by a device disposed downstream the aerosol flow path and connected to the aerosol output port 6.

FIRST EMBODIMENT

Table 1 shows typical ion concentrations obtained by the neutralizer of the present invention, with comparison with ion concentrations by using a radiative source ($^{241}$Am), The same bipolar ion concentration is obtained by controlling positive and negative voltages of the neutralizer of the present invention. It can be seen that ions of a higher concentration can be generated more than using the radiative source. It can be estimated from these results that the neutralizer utilizing discharge has a neutralization performance not inferior to that of the neutralizer utilizing the radiative source. It can be understood that a ratio of positive ions to negative ions can be controlled in a range of 0.8 to 1.5 by controlling positive and negative voltages.

TABLE 1

| | | | $n^+$ | $n^-$ |
|---|---|---|---|---|
| ION CONCENTRATION ($m^{-3}$) | AEROSOL NEUTRALIZER (INVENTION) | $n^+/n^- = 1.5$ | $1.2 \times 10^{13}$ | $0.8 \times 10^{13}$ |
| | | $n^+/n^- = 1.0$ | $1.0 \times 10^{13}$ | $1.0 \times 10^{13}$ |
| | | $n^+/n^- = 0.8$ | $0.9 \times 10^{13}$ | $1.1 \times 10^{13}$ |
| | NEUTRALIZER (241 Am) | $n^+/n^- = 1.0$ | $0.8 \times 10^{13}$ | $0.8 \times 10^{13}$ |

SECOND EMBODIMENT

The aerosol charge neutralization characteristics of the neutralizer of the present invention has been studied experimentally. Simple dispersion and uncharged test particles (particle diameter: 20 to 200 nm) were obtained by using polystyrenelatex (PSL) and dioctylsebacate (DOS) formed through spraying and drying, a differential mobility analyzer (DMA), a first neutralizer ($^{241}$ Am) and a condenser. The obtained test particle were introduced into the neutralizer of the present invention, and before and after the introduction, changes in the total number of particles and the number of charged particles were measured with a condensation nucleus counter. The measurement results are shown in FIG. 6. As seen from FIG. 6, a tendency that as the particle diameter increases, a charged particle ratio increases is generally coincident with the neutralizer ($^{241}$ Am) utilizing radioactive substance, and fairly coincident with theoretically estimated values (a solid line in the figure).

FIG. 6 shows a comparison between a ratio of charged particles to the total number of particles by the neutralizer of the present invention, with comparison with the theoretical values (a theoretical line obtained from Non-Patent Document 3). It can be seen that a charge quantity by the neutralizer of the present invention is equal for the particle diameters of 33 nm to 200 nm. It can be understood from these results that particle charge neutralization by the neutralizer of the present invention is good.

INDUSTRIAL APPLICABILITY

The aerosol charge neutralizer of the present invention does not use radioactive substance, but uses bipolar ion generator elements by utilizing pulse voltages applied with DC biases. There is therefore no restriction in using the neutralizer otherwise to be caused by use permission and dealing permission. Further, dealing and storage of the neutralizer are easier than the neutralizer utilizing radioactive substance. Furthermore, since the pulse voltages applied with DC biases are used, generation of ozone can be suppressed not larger than 100 ppb so that measurements of aerosol utilizing charge neutralization becomes extremely simple.

A measurement sensitivity of aerosol can be improved by changing a bipolar ion concentration balance.

What are claimed are:

1. An aerosol charge neutralizer comprising:

an aerosol flowing container having an aerosol input port at an upstream end, an aerosol output port at a downstream end, a tubular body made of conductive material and constituting an aerosol flow path capable of flowing aerosol, and an opening pair having a pair of openings disposed facing each other via a center line of said tubular body, each opening extending through a wall of said tubular body;

an insulating tube having a tubular portion made of insulating material and a window pair having a pair of windows disposed facing each other via the center line of said tubular portion, each window extending through a wall of said tubular portion, and said insulating tube being concentrically engaged with an outer surface of said aerosol flowing container in such a manner that said window becomes coincident in position with said opening;

a bipolar ion generator element having a discharge electrode formed on a dielectric film and closing said window, said bipolar ion generator element being mounted on said insulating tube in such a manner that said discharge electrode is exposed in said aerosol flow path; and an outer tube accommodating said insulating tube, said opening and said bipolar ion generator element in an airtight manner relative to said aerosol flowing container.

2. The aerosol charge neutralizer according to claim 1, wherein there is one or more said opening pairs and said window pairs.

3. The aerosol charge neutralizer according to claim 1, wherein said outer tube has a sealing portion for maintaining an airtight state between said outer tube and said aerosol flowing container by using an O-ring.

4. The aerosol charge neutralizer according to claim 1, wherein there are a plurality of pairs of said bipolar ion generator elements, said plurality of pairs are disposed in such a manner that a positive ion generator element and a negative ion generator element are alternately disposed around said center line, and each pair is disposed in such a manner that the ion generator elements of the same polarity are disposed facing each other via said center line.

5. The aerosol charge neutralizer according to claim 1, wherein said discharge electrode of said bipolar ion generator element is disposed in parallel to a main stream direction of aerosol.

* * * * *